US005715539A

United States Patent [19]

Benecki et al.

[11] Patent Number: 5,715,539

[45] Date of Patent: Feb. 10, 1998

[54] GLOVES AND IMPLEMENTS CONTAINING A FLEXIBLE MAGNETIC STRIP TO IMPROVE GRIP

[75] Inventors: Walter T. Benecki, Elgin; Lawrence J. Kosiek, Mount Prospect, both of Ill.

[73] Assignee: The Arnold Engineering Company, Marengo, Ill.

[21] Appl. No.: 691,508

[22] Filed: Aug. 2, 1996

[51] Int. Cl.[6] ..... A41D 19/00

[52] U.S. Cl. ..... 2/160; 2/161.1; 2/161.2; 2/161.6

[58] Field of Search ..... 2/161.3, 17, 19, 2/158, 159, 160, 161.1, 161.2, 161.6, 163, 161.8; 294/25, 65.5; 273/345

[56] References Cited

U.S. PATENT DOCUMENTS

| | | | |
|---|---|---|---|
| 1,174,887 | 3/1916 | Meriwether | 294/65.5 |
| 3,321,119 | 5/1967 | D'Andrea | 224/5 |
| 3,636,568 | 1/1972 | Stuner | 2/161 |
| 3,886,508 | 5/1975 | Lavrard | 2/94 |
| 4,006,900 | 2/1977 | DiVito | 273/95 |
| 4,240,157 | 12/1980 | Peters | 2/161.6 |
| 5,143,371 | 9/1992 | Strahan | 273/32 |
| 5,365,609 | 11/1994 | Herzog | 2/161.4 |
| 5,507,041 | 4/1996 | Wright | 2/21 |

*Primary Examiner*—C. D. Crowder
*Assistant Examiner*—Larry D. Worrell, Jr.
*Attorney, Agent, or Firm*—Woodcock Washburn Kurtz Mackiewicz & Norris LLP

[57] ABSTRACT

Ways to improve one's grip on an implement through the use of thin, flexible magnetic strips are provided. The flexible magnetic strips can be used with the glove used by the person gripping the implement or with the implement's gripping surface, or with both. Alternatively, the flexible magnetic strips can be used with either the glove or the implement, with the opposing glove or implement surface coated or imbedded with a magnet attracting material. The user's grip is improved due to the magnetic interaction between the glove and the implement.

4 Claims, 4 Drawing Sheets

GLOVES AND IMPLEMENTS CONTAINING A FLEXIBLE MAGNETIC STRIP TO IMPROVE GRIP

FIELD OF THE INVENTION

The present invention relates to gloves or implements that contain either a flexible magnetic strip to improve the grip of a user on an implement. The implements with which the present invention is advantageously employed include, among others, sporting devices such as bats, racquets, clubs, sticks, etc.

BACKGROUND OF THE INVENTION

Many sporting and gardening activities, and particularly sporting activities, require the proper gripping pressure to maximize the output from the implement being held to the object being struck. The problem is applying an efficient, yet controlling and comfortable grip while swinging the implement. It is commonly believed that people grip implements too tightly due to their fear of losing their grip when the implement is held lightly. However, gripping an implement too tightly creates tension in the lower arm and wrist that restricts the movement resulting in a reduction of kinetic energy from the implement to the struck object. Trying to achieve a gripping pressure to maximize the energy transfer from the implement to the object to be struck in a comfortable fashion may negatively affect the output of the swing. This reduction in output is primarily due to restricted flexibility and mobility of the lower arm.

A solution to improving one's grip on an object is to simply grip the object more tightly. However, this creates tension in the lower arm—wrist and forearm—and restricts body movement resulting in loss of range of motion. The loss of range and motion ultimately results in a loss of control over the object being struck. By reducing the tension in the lower arm, improved flexibility is achieved and the range of body motion is improved thus resulting in improved performance. However, if the tension is reduced too far, the grip is lost. Therefore, it is an ideal situation to increase one's grip without having to increase the tension of the lower arms.

Previous attempts to improve the grip on an object have included placing VELCRO® on gloves. However, these gloves tend to improve the grip too much, resulting in problems with users trying to readjust their grip and having difficulty in doing so. VELCRO® gripping systems also tend to become dirty during use since they attract dirt and debris. Leather has been used for gloves to improve one's grip on an implement. However, leather gloves can become wet due to perspiration from the user or from rain. When leather gloves become wet their use for improving one's grip is dramatically reduced.

A need therefore exists for improved designs of both gloves and the gripping surface of implements to be gripped or handled. Such designs should enable a user to comfortably improve one's grip on the implement without increasing the tension in the lower arm.

SUMMARY OF THE INVENTION

The present invention provides various gripping systems to improve the grip on an object or implement through the use of thin, flexible magnetic strips. In one embodiment, flexible magnetic strips are either used to constitute the surface of a glove or the strips are attached to the glove surface, and the strips are similarly associated with the gripping surface of the implement. In another embodiment, the flexible magnetic strips are associated with either the glove surface or the gripping surface of the implement, and the opposing glove or implement surface contains magnet attracting materials. In a further embodiment, the flexible magnetic strips are associated with the glove surface and rigid magnets are associated with the implement. In such a way there is created a magnetic attraction between the glove and implement, which attraction improves the user's grip.

The present invention thus provides a glove containing a magnetic material for improving the grip of the wearer of the glove. The glove is comprised of individual finger-receiving portions connected to a hand-receiving portion. The finger-receiving portions have a front surface and a back surface and the hand-receiving portion has a palm surface and a back surface. The glove has a glove front surface comprising the finger-receiving front surfaces and the palm surface. A thin, flexible magnetic strip is associated with at least a portion of the glove front surface. The strip can be associated with the glove front surface by either constituting a portion or the entirety of the glove surface, or the strip can be attached to a portion or the entirety of the glove surface. The flexible magnetic strip has a thickness of between about 0.001 and about 0.375 inches and is magnetized to have about 1–20 poles per square inch.

The present invention also provides for implements having an improved gripping surface. The implement has a gripping surface that can be gripped by a human hand, and that gripping surface has associated thereto at least one thin, flexible magnetic strip or at least one thin, rigid magnetic strip. The magnetic strip has a thickness of between about 0.001 and about 0.375 inches and is magnetized to have about 1–20 poles per square inch.

The present invention also provides for gloves and implements as described above with a magnet attracting material imbedded into or coated onto the surface of the glove or implement.

The present invention also provides for methods for improving the grip on an implement where the user puts on a glove as described above and grips an implement as described above, whereby the grip on said implement is increased and improved due to the magnetic attraction between the magnetic strip in the glove and in the implement. The method can also be practiced with the same glove with an implement that contains a magnet attracting material on its gripping surface. The method can further be practiced by using the implement with the magnetic strip material associated therewith along with a glove that contains a magnet attracting material on its surface.

The use of the improved gripping system as set forth in the present invention enables one to have a lighter and more relaxed hand grip on an implement without losing any overall grip pressure and control of the implement. This is accomplished through the magnetic attraction between the magnetic strips and the magnet attracting material or the magnetic strips contained on the gloves/implements. The improved grip allows the user to release tension in the lower arm and thereby improve his/her flexibility and mobility through the activity.

The improved grip is useful in sporting activities because it can assist in controlling and aligning the bat, club, racquet, or stick face to the target. Also, the improved grip provides confidence to the user to employ a lighter gripping pressure. Further, the improved grip assists in maintaining a good grip on the bat, club, or stick during mis-hits, imperfect hits, and off-center hits.

The magnetic gripping system of the present invention is superior to gripping systems based on VELCRO® or leather gloves. In those latter systems, the improved grip provided by the gloves is diminished during use due to dirt, debris and/or wetness. In the present magnetic system, the grip is not affected by dirt and wetness.

DETAILED DESCRIPTION OF THE INVENTION

Figure 1:
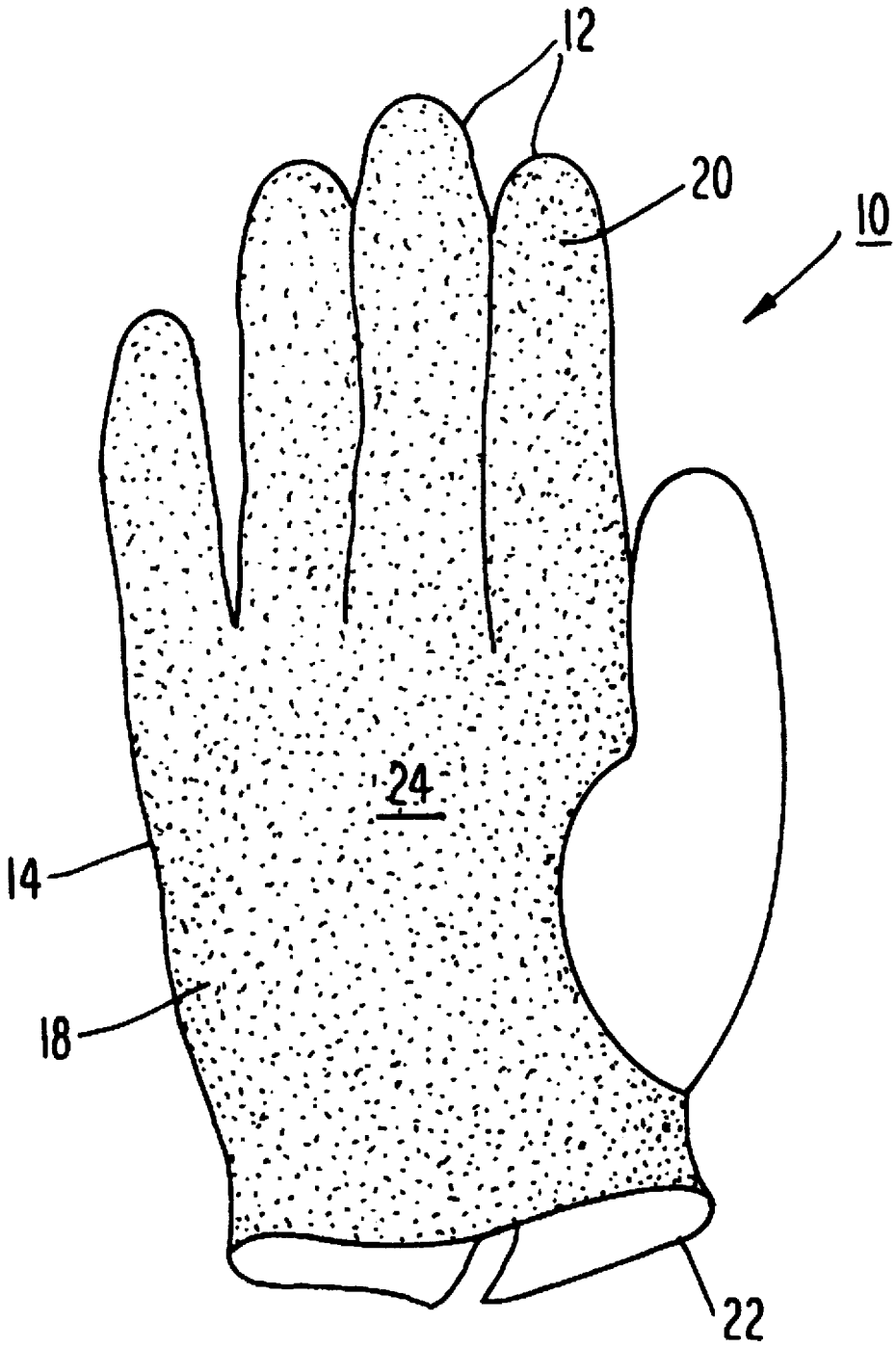
FIG. 1 is a view of a glove containing the flexible magnetic strips of the present invention.

The present invention provides ways to improve one's grip on an implement through the use of magnetic materials such as thin, magnetic strips and magnet attracting materials. The magnetic strips can be used in both the glove used by the person gripping the implement and in the gripping surface of the implement. In another embodiment, the magnetic strips are used on either the glove surface or on the implement gripping surface, with a magnet attracting material provided on the opposing glove or implement gripping surface. The magnetic strips that are used on the gloves are preferably made of a flexible material to allow for free motion of the hand. The magnetic strips that are used on the gripping surface of the implement can either be made of a flexible or rigid material.

The flexible magnetic strips can be comprised of various types of flexible magnetic materials. The flexible magnetic materials should have developed magnetic properties such that they possess a remanence, $B_r$, value of at least about 1 kilogauss (kG), preferably from about 1 to about 8 kG, and more preferably from about 4 to about 5.5 kG. The magnetic material generally has an energy product, $BH_{max}$, of at least about $1.2\times10^6$ gauss-oersted, preferably from about $1.2–5.2\times10^6$ gauss-oersted, and more preferably from about $4.5–5.2\times10^6$ gauss-oersted. The magnetic material is produced to have a specified magnetic pattern designated as poles per square inch (ppi), and for the purposes of the present invention this value is generally from about 1 to about 20 ppi and preferably from about 2 to about 16 ppi.

The magnetic strips must be flexible to be used in a glove to allow for the hand to change grip positions without a restricted feeling to the user. As such, the magnetic strips used for the gloves have flexibility as an important physical characteristic. As those of skill in the art readily realize, the measurement of flexibility of such magnetic strips can be made by various testing techniques. For the purposes of this invention, the magnetic strip is defined as being flexible if it can be bent to a 45° angle repeatedly without breaking and with minimal hand pressure.

Such flexible magnetic strips are commercially available from the Arnold Engineering Company. Suitable products include the PLASTIFORM® line of materials, particularly PLASTIFORM® B-1013, B-1030, B-1033, and B-1315. These flexible magnetic materials contain oriented barium or strontium ferrite magnetic material within a nitrile vinyl or other rubber binder. Other combinations of magnetic materials are also suitable as are other binders. Another suitable product is PLASTIFORM® 1201, which contains Nd/Fe/B magnetic material within a nitrile rubber binder. The magnetic material in these PLASTIFORM® products and other combinations of magnetic materials are suitable as are other binder materials. These flexible magnetic materials are generally from about 0.001 to about 0.375 inches thick, preferably from about 0.01 to about 0.25 inches thick, and more preferably from about 0.03 to about 0.15 inches thick. The PLASTIFORM® products are commercially available from The Arnold Engineering Company. The flexible magnetic strips can be used in sections of any width or overall geometry, and thus need not be in a rectangular shape.

Either the glove or the implement to be gripped, or both, can comprise the flexible magnetic strips. FIG. 1 illustrates the embodiment wherein the thin, flexible magnetic strip material constitutes the front surface of a glove. The glove 10 has a plurality of finger-receiving portions 12 connected to a hand-receiving portion 14. The finger-receiving portions 12 have finger-receiving front surfaces 20 and an opposing back surface (not shown). The hand-receiving portion 14 has a palm surface 18 and a back surface 22. Combined, the palm surface 18 and the finger-receiving front surfaces 20 constitute the glove front surface. In FIG. 1, the flexible magnetic strip material 24 is shown as covering the entirety of the glove front surface. In this embodiment, the front surface of the glove 10 is constructed with the strip material 24 and the back surface of the glove can be constructed of any material commonly used for such purposes, such as cotton, leather, neoprene, rubber, synthetic fibers, etc. The strip material 24 can also constitute a portion of the glove front surface. The strip material 24 and the remainder of the glove can be joined by any of the known conventional techniques such as sewing, adhesion, etc. The strip material 24 can also be used to construct the front surface of the thumb, although not shown as such in FIG. 1, where the strip material 24 thus constitutes a portion of the glove front surface.

Figure 2:
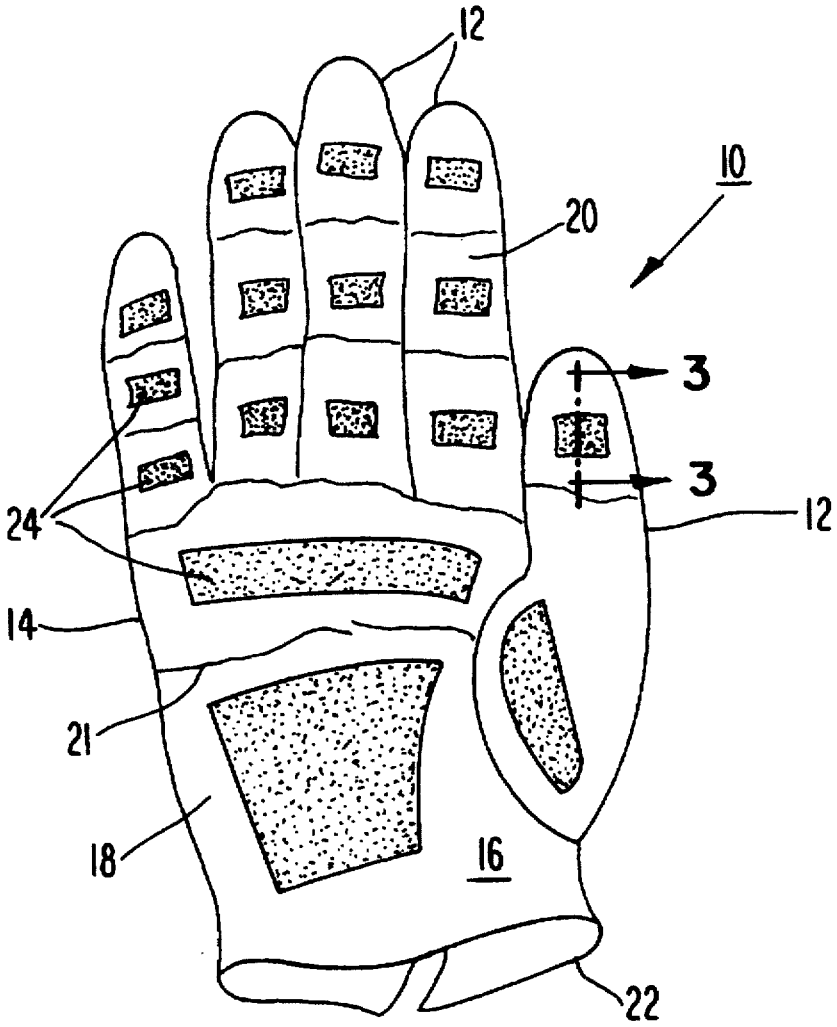
FIG. 2 is a view of a glove containing the flexible magnetic strips of the present invention.

The flexible magnetic material can be used to constitute the front surface of the glove, or a portion thereof, as shown in FIG. 1. The flexible magnetic material can also be incorporated into the front surface of the glove. Thus, another embodiment for the glove that comprises the magnetic material is shown in FIG. 2. As shown in FIG. 2, the flexible magnetic strips are incorporated into the glove 10. The glove 10 can be constructed of any materials commonly used for such purposes. Examples of such materials include cotton, leather, neoprene, rubber, synthetic fibers, etc. In this embodiment, the flexible magnetic strip material 24 is attached to the glove front surface 16 by any means such as being imbedded or secured thereto. The flexible magnetic strip material 24 can take any arrangement on the glove front surface 16. As shown in FIG. 2, the flexible magnetic strip material 24 covers a substantial portion of the glove front surface 16. It is preferred that the flexible magnetic strips 24 are located between the anticipated glove creases 21 created by the use of the glove and the gripping of the hand. The flexible magnetic strips 24 can be attached only to the finger-receiving front surfaces 20 or only to the palm surface 18 in different embodiments.

Figure 3A:
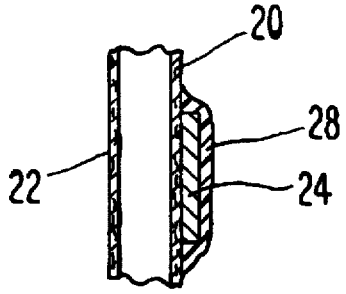
FIGS. 3*a* and 3*b* are cross-sectional views taken along the line 3—3 of the glove shown in FIG. 2.
Figure 3B:
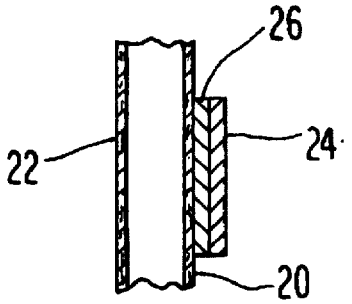

The flexible magnetic strips 24 can be attached to the glove front surface 16 by any suitable means. For instance, the flexible magnetic strips 24 can be attached by means of an adhesive material such as a tape or glue composition as shown in FIGS. 3*a* and 3*b*. In FIG. 3*a*, the flexible magnetic strip 24 is attached to the glove front surface 16, such as the finger-receiving surface 20, by means of a glue or polymeric resin material 28. In FIG. 3*b*, the flexible magnetic strip 24 is attached to the finger-receiving surface 20 by means of an adhesive 26.

Figure 4:
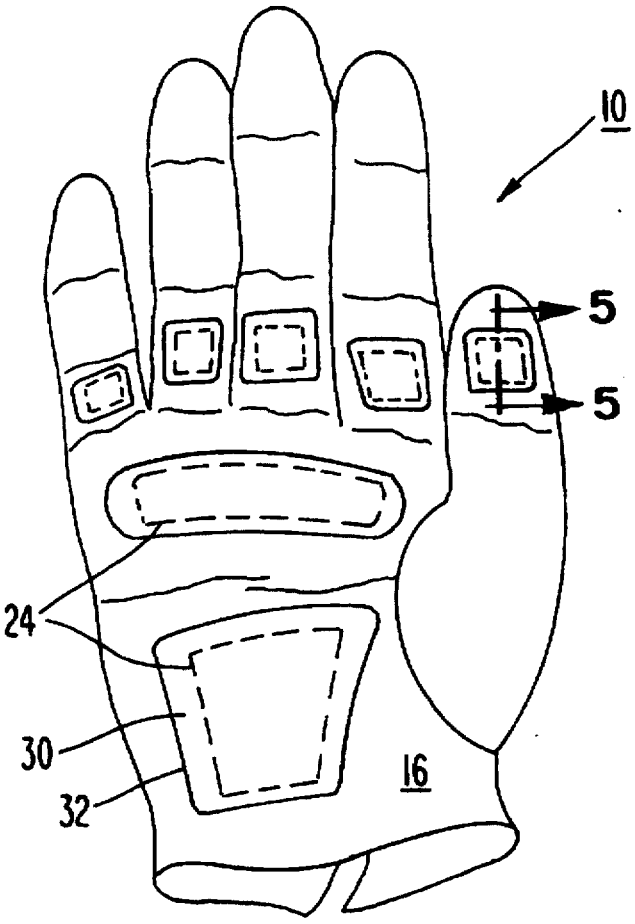
FIG. 4 is a view of a glove containing the flexible magnetic strips of the present invention.
Figure 5:
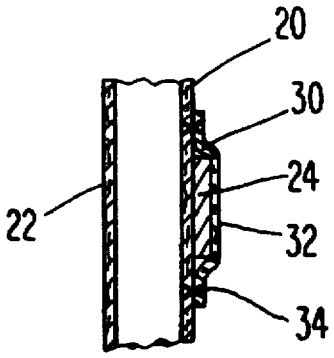
FIG. 5 is a cross-sectional view taken along line 5—5 of the glove shown in FIG. 4.

The flexible magnetic strips 24 also can be attached to the glove front surface 16 by being sewn into the glove 10 as shown in FIG. 4. In this embodiment, the flexible magnetic strips 24 are positioned between the glove front surface 16 and a glove patch 32. The glove patch 32 can be made of the same material as the glove front surface 16 and is itself attached to the glove front surface 16 by means of stitches, etc. A cross-sectional view of this attachment embodiment is shown in FIG. 5 where the flexible magnetic strips 24 are attached to the finger-receiving surface 20 by means of the glove patch 32. The glove patch 32 is sewn to the finger-receiving surface by means of stitches 34, thus defining a pocket 30 in which the flexible magnetic strip is positioned.

The glove 10 containing the flexible magnetic strips 24 can then be used in conjunction with an implement to be gripped that contains on its gripping surface either flexible magnetic strips such as those described above, rigid magnetic strips, or a magnet attracting material. Implements that can be gripped in an improved fashion in accordance with the present invention include, but are not limited to, baseball and softball bats, golf clubs, hockey sticks, tennis and racquet ball racquets, lacrosse sticks, skiing poles, water ski handles, fishing rods, weight lifting bars, shovels, rakes, hoes, hatchets, hammers, sledge hammers, axes, etc. The present invention is particularly suited for use in sporting equipment situations.

The rigid magnetic strips that can be used on the gripping surface of the implements have similar magnetic properties as described for the flexible magnetic strips. These materials can be made of conventional magnetic materials.

Figure 6A:
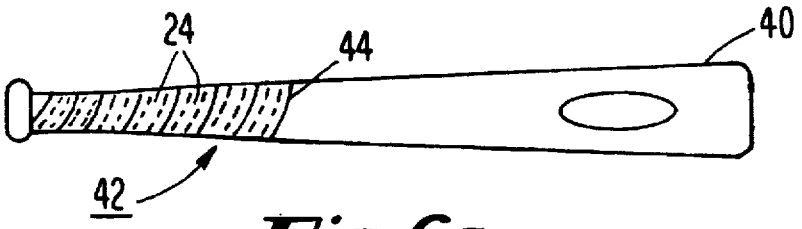
FIG. 6*a* shows a bat containing the flexible magnetic strips of the present invention on its handle.

FIG. 6*a* shows a baseball or softball bat 40 that contains the flexible or rigid magnetic strip material 24 on its handle 42. The magnetic strip material 24 can be attached to the handle 42 by means of tape 44. As set forth above with respect to the attachment of the magnetic strips 24 to the glove 10, similar attachment means can be used to secure the strips to the implement to be gripped, e.g. tapes, adhesives, sewing, etc. Also, the magnetic strip material 24 can be used to constitute the surface of the handle 42, with appropriate means to attach the magnetic strip material to the bat 40. Thus, the magnetic strip material can be associated with the glove and/or implement gripping surface portion by either constituting that surface or by being attached to that surface by such means as imbedded within a pouch, affixed by an adhesive, or coated by an adhesive, etc.

Figure 6B:
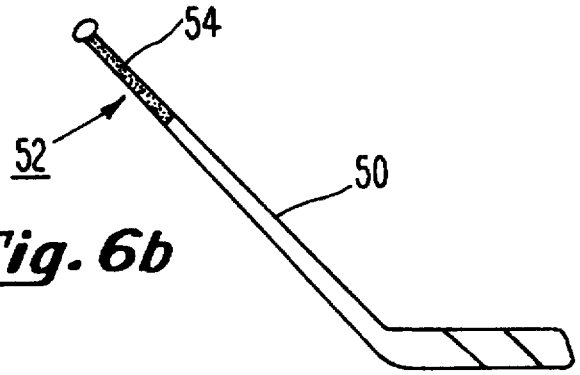
FIG. 6*b* shows a sports stick, such as a golf club, hockey stick, etc., containing magnet attracting material on its handle.

The implement to be gripped can also contain on or in its gripping surface a magnet attracting material. Such materials include metal particles or shavings disposed on the gripping surface. The metal particles or shavings can be disposed on the gripping surface in any fashion, such as by a paint or polymeric coating composition that contains such particles or shavings or by a tape having such particles or shavings disposed therein. As shown in FIG. 6*b*, the handle 52 of a stick 50, such as a golf club, hockey stick, etc., is coated with such metallic particles or shavings 54. One way to supply such particles or shavings is to spray the handle 52 with a composition such as MAGNA-PAINT (Homax®), which is a water-based composition that contains small metal particles and which dries to create a magnet attracting surface. The thickness of the coating containing such metal particles can vary for the particular use, however common coating thicknesses are on the order of about 0.001 to about 0.25 inches, more commonly from about 0.001 to about 0.125 inches.

Figure 7:
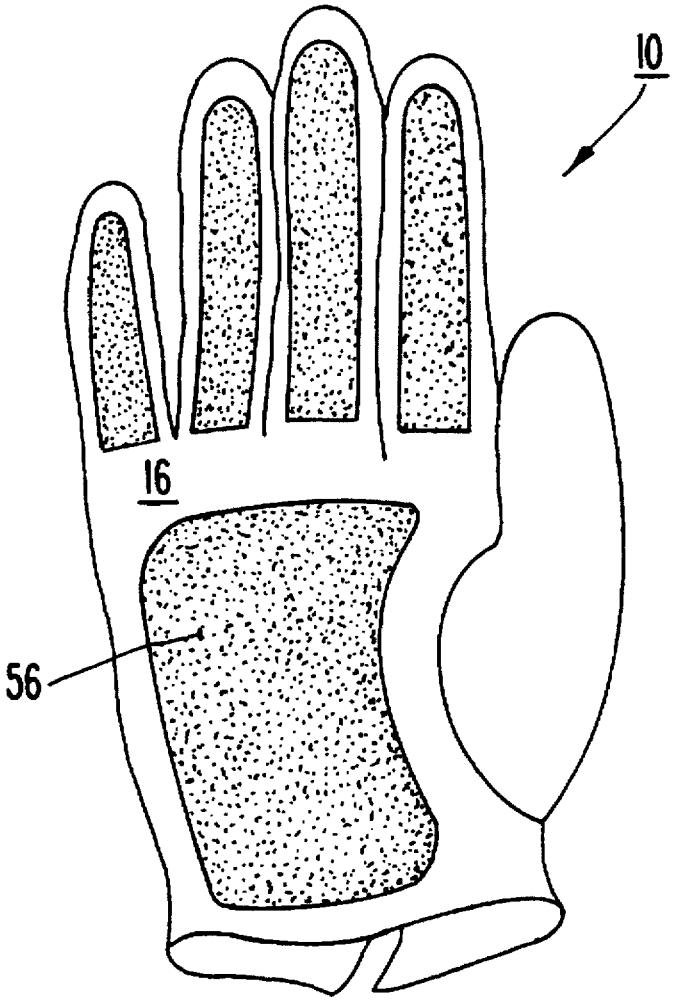
FIG. 7 is a glove containing magnet attracting material on its surface.

The improved gripping system of the present invention can be achieved by three general designs. In the first design, the glove contains the flexible magnetic strip material and the implement to be gripped contains the flexible or rigid magnetic strip material. In the second design, the glove contains the flexible magnetic strip material and the implement to be gripped contains the magnet attracting material on or in its gripping surface. In the third design, the glove contains the magnet attracting material and the implement to be gripped contains the flexible or rigid magnetic strip material on its gripping surface. In the third design, the glove 10, as shown in FIG. 7 contains the magnet attracting material 56 on at least a portion of the glove front surface 16. Again, the thickness of the coating can vary, although typically will be On the order of from about 0.001 to about 0.125 inches. Also, the magnet attracting material 56 can be used on the entirety of the glove front surface, that is, covering the thumb surface in FIG. 7.

Figure 8:
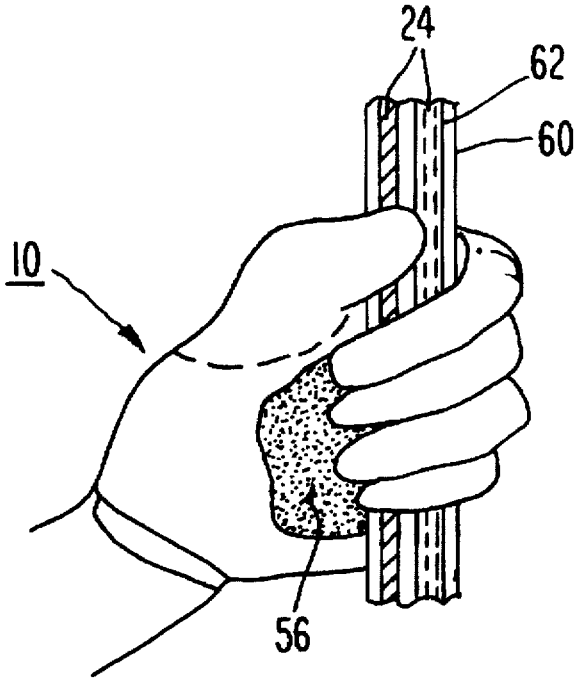
FIG. 8 shows a grip of a club handle using the improved gripping system of the present invention.

The grip on the implement is readily improved by the magnetic interaction between the glove and the implement in accordance with the glove/implement designs of the present invention. This improved grip provides added confidence to the user with the reassurance of a more reliable and powerful grip. This advantage is particularly important in sporting equipment situations where the improvement in the grip allows the sports participant to grip the implement with less pressure and thereby improve his/her flexibility during the sporting activity. The grip on an implement 60 is shown in FIG. 8. In this embodiment, the glove 10 contains magnet attracting material 56 that is magnetically attracted to the magnetic strips 24 on the implement 60. In this embodiment, the magnetic strips 24 are shown as being attached to the implement 60 itself on the left, by means of an underlying adhesive (not shown), and by means of a adhesive coating, such as a tape, 62, on the right.

EXAMPLE

The improved grip that is achievable from the present invention can be illustrated by the following example. Various combinations of a magnetic material with either another magnetic material or with a material coated with a magnetic coating were used to demonstrate the improved holding and sliding forces that can be attained by means of the present invention.

The holding and sliding forces were measured by means of a GCA/Precision Scientific, Scott-CRE/500 tension/compression tester. The samples used in the testing were of a rectangular shape and had surface areas of about 2.75 in.$^2$. The samples tested consisted of the magnetic materials set forth in Table 1, as described above, and the magnetic coating sample was prepared by applying two coats of MAGNA-PAINT, as described above, on a fiberboard backing.

The sliding force between the two samples was measured by placing a double-sided adhesive tape to the back of the sample with the other side of the tape affixed to the clamp attached to the tester. When the two samples were attached to the clamps, the tension indicator was reset to zero and the speed was set at 2 in./min. The tester was then turned on and the one sample was pulled apart from the other stationary sample at the test rate in a sliding motion. The sliding force recorded was the force measured as the maximum force recorded during the sliding test.

The holding force between the two samples was measured by again placing a double-sided adhesive tape to the back of the sample with a post, mounted to the testing clamp, affixed to the other side of the tape. The two samples were pressed together, and the tension indicator was reset to zero. The tester was then turned on and the samples were pulled apart from each other in opposite directions. The holding force recorded was the maximum force measured as separation occurred.

The results of the sliding and holding forces are set forth in Table 1.

TABLE 1

| Sample/Sample | Sample Thickness | Magnetization Pattern | Holding Force (PSI) | Sliding Force (PSI) |
|---|---|---|---|---|
| B1030/B1030 | 0.03/0.03 | 18 ppi/18 ppi | 0.3 | 0.7 |
| B1033/B1033 | 0.03/0.03 | 18 ppi/18 ppi | 0.5 | 0.8 |
| B1315/B1315 | 0.03/0.03 | 18 ppi/18 ppi | 1.0 | 0.7 |
| B1030/Magna-Paint | 0.03/— | 18 ppi/— | 0.2 | 0.3 |
| B1033/Magna-Paint | 0.03/— | 18 ppi/— | 0.4 | 0.3 |
| B1315/Magna-Paint | 0.03/— | 18 ppi/— | 0.2 | 0.1 |
| 1201/1201 | 0.03/0.03 | 8 ppi/8 ppi | 1.4 | 2.3 |
| 1201/Magna-Paint | 0.03/— | 8 ppi/— | 0.2 | 0.5 |

What is claimed is:

1. A glove containing a magnetic material for improving the grip of the wearer of the glove, said glove comprising:

individual finger-receiving portions connected to a hand-receiving portion, said finger-receiving portions having a front surface and a back surface, said hand-receiving portion having a palm surface and a back surface, whereby said glove has a glove front surface comprising said finger-receiving front surfaces and said palm surface; and wherein at least a portion of said glove front surface comprises a thin, flexible magnetic strip, said flexible magnetic strip having a thickness of between about 0.001 and about 0.15 and having between about 2–20 poles per square inch.

2. The glove of claim 1 wherein said flexible magnetic strip constitutes at least a portion of the glove front surface.

3. The glove of claim 1 wherein said flexible magnetic strip is attached to said glove front surface.

4. The glove of claim 1 wherein said flexible magnetic strip is attached to said finger-receiving front surfaces and to said palm surface.

* * * * *